US010252885B2

(12) United States Patent
Ericson

(10) Patent No.: US 10,252,885 B2
(45) Date of Patent: Apr. 9, 2019

(54) ROPELESS ELEVATOR SYSTEM GUIDE RAIL ASSEMBLY

(71) Applicant: OTIS ELEVATOR COMPANY, Farmington, CT (US)

(72) Inventor: Richard J. Ericson, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 58 days.

(21) Appl. No.: 15/226,984

(22) Filed: Aug. 3, 2016

(65) Prior Publication Data

US 2017/0036889 A1 Feb. 9, 2017

Related U.S. Application Data

(60) Provisional application No. 62/200,167, filed on Aug. 3, 2015.

(51) Int. Cl.

| | |
|---|---|
| ***B66B 9/00*** | (2006.01) |
| ***B66B 7/02*** | (2006.01) |
| *B66B 11/04* | (2006.01) |

(52) U.S. Cl.

CPC ..... *B66B 7/02* (2013.01); *B66B 7/023* (2013.01); *B66B 7/025* (2013.01); *B66B 9/003* (2013.01); *B66B 11/0407* (2013.01)

(58) Field of Classification Search

CPC ... B66B 9/003; B66B 2009/006; B66B 7/021; B66B 11/0407; B65G 1/0414; B65G 1/0492

See application file for complete search history.

(56) References Cited

U.S. PATENT DOCUMENTS

| | | | | |
|---|---|---|---|---|
| 1,859,483 | A * | 5/1932 | Winslow | B66B 9/003 187/270 |
| 3,317,005 | A * | 5/1967 | Kehoe | B66B 9/003 104/25 |
| 4,986,714 | A | 1/1991 | Fernstrom | |
| 5,433,293 | A * | 7/1995 | Sager | B66B 7/022 182/12 |
| 5,601,156 | A | 2/1997 | McCarthy et al. | |
| 5,657,835 | A | 8/1997 | Bittar | |

(Continued)

FOREIGN PATENT DOCUMENTS

| | | | |
|---|---|---|---|
| CN | 103183279 | A | 7/2013 |
| CN | 203820241 | U | 9/2014 |

(Continued)

OTHER PUBLICATIONS

English Machine Translation of JPH 09-278315.*

(Continued)

*Primary Examiner* — Diem M Tran

(74) *Attorney, Agent, or Firm* — Cantor Colburn LLP

(57) ABSTRACT

An elevator system that may be ropeless is in a structure and includes a guide rail and a guide rail extension that may generally guide a car between a hoistway and a transfer station of the system. The rail extension may generally project telescopically downward from the first rail and toward the transfer station. The telescopic relationship between the guide rail extension and the guide rail may generally compensate for vertical structure compression that may occur over a period of time.

15 Claims, 6 Drawing Sheets

(56) References Cited

U.S. PATENT DOCUMENTS

| | | | | |
|---|---|---|---|---|
| 5,660,249 | A | 8/1997 | Powell et al. | |
| 5,799,755 | A | 9/1998 | Wan et al. | |
| 5,829,553 | A | 11/1998 | Wan et al. | |
| 5,861,586 | A | 1/1999 | McCarthy et al. | |
| 5,950,769 | A | 9/1999 | Barker et al. | |
| 6,955,245 | B2 | 10/2005 | Dunser et al. | |
| 7,537,089 | B2 | 5/2009 | Duenser et al. | |
| 7,621,376 | B2 | 11/2009 | Duenser et al. | |
| 2011/0042168 | A1 | 2/2011 | Grundmann | |
| 2014/0190774 | A1* | 7/2014 | Hsu | B66B 9/003 187/406 |
| 2016/0115788 | A1* | 4/2016 | Webb | B66B 9/16 187/406 |

FOREIGN PATENT DOCUMENTS

| | | | | |
|---|---|---|---|---|
| DE | 2154923 | A1 * | 5/1973 | B66B 9/00 |
| EP | 0776858 | A2 | 6/1997 | |
| JP | H05124781 | A | 5/1993 | |
| JP | H0616365 | A | 1/1994 | |
| JP | H09278315 | A | 10/1997 | |

OTHER PUBLICATIONS

English Machine Translation JPH 06-16365.*
Extended European Search Report for Application No. 16182617.1 dated Jan. 24, 2017. (7 pages).

* cited by examiner

ROPELESS ELEVATOR SYSTEM GUIDE RAIL ASSEMBLY

CROSS REFERENCE TO RELATED APPLICATION

This application claims priority to provisional Patent Application No. 62/200,167, filed Aug. 3, 2015, the entire contents of which is incorporated herein by reference.

BACKGROUND

The present disclosure relates to elevator systems, and more particularly to a guide rail assembly of a ropeless elevator system.

Self-propelled elevator systems, also referred to as ropeless elevator systems, are useful in certain applications (e.g., high rise buildings) where the mass of the ropes for a roped system is prohibitive and there is a desire for multiple elevator cars to travel in a single lane. There exist self-propelled elevator systems in which a first lane is designated for upward traveling elevator cars and a second lane is designated for downward traveling elevator cars. At least one transfer station is provided in the hoistway to move cars horizontally between the first lane and second lane. Improvements in car transfer between lanes is desirable.

SUMMARY

An elevator system according to one, non-limiting, embodiment of the present disclosure includes a first rail; and a first rail extension projecting telescopically downward from the first rail.

Additionally to the foregoing embodiment, the system includes a structure defining a hoistway; and an elevator car constructed and arranged to travel in the hoistway and guided by the first rail.

In the alternative or additionally thereto, in the foregoing embodiment, the system includes a structure defining a hoistway including first and second lanes each extending vertically with the first rail disposed in the first land and the second rail disposed in the second lane; and a transfer station defined by the structure and communicating between adjacent lanes of the plurality of lanes, and wherein the first rail extension projects toward the transfer station.

In the alternative or additionally thereto, in the foregoing embodiment, a second rail extension projecting telescopically downward from the second rail and toward the transfer station.

In the alternative or additionally thereto, in the foregoing embodiment, the first and second rail extensions are disposed at least in-part in the transfer station.

In the alternative or additionally thereto, in the foregoing embodiment, the system includes an elevator car constructed and arranged to travel in the first and second lanes and guided by the respective first and second rails.

In the alternative or additionally thereto, in the foregoing embodiment, the system includes a carriage disposed in the transfer station and constructed and arranged to receive the elevator car for transfer between the first and second lanes.

In the alternative or additionally thereto, in the foregoing embodiment, the carriage includes a coupling rail aligned to the first rail extension when transferring the elevator car between the first lane and the transfer station and aligned to the second rail extension when transferring the elevator car between the second lane and the transfer station.

In the alternative or additionally thereto, in the foregoing embodiment, the structure includes a first portion and a second portion disposed above the first portion and substantially defining the hoist way, and wherein the first portion is generally stationary and the second portion is constructed and arranged to displace vertically under a compressive load.

In the alternative or additionally thereto, in the foregoing embodiment, the first rail extension is rigidly engaged to the first portion and the first rail is engaged to the second portion.

In the alternative or additionally thereto, in the foregoing embodiment, the system includes a plurality of rail clips engaged between the second portion and the rail, wherein each clip of the plurality of rail clips is spaced vertically from an adjacent clip of the plurality of clips, and wherein the rail displaces vertically with respect to the plurality of rail clips under a compressive load of the second portion.

In the alternative or additionally thereto, in the foregoing embodiment, the first rail and the first rail extension slideably overlap vertically.

In the alternative or additionally thereto, in the foregoing embodiment, a distal end portion of the first rail is vertically received in a cavity defined by the first rail extension.

In the alternative or additionally thereto, in the foregoing embodiment, the elevator system is ropeless.

In the alternative or additionally thereto, in the foregoing embodiment, the elevator system includes a structure assembly having an inverted U-shape; an adjustable guide rail bracket engaged to the first rail and supported by the structure assembly; and a rail extension bracket rigidly engaged to the first rail extension and the structure assembly and slideably engaged to the first rail An elevator system according to another non-limiting embodiment of the present disclosure includes a structure defining a hoistway including first and second lanes each extending vertically, and defining first and second transfer stations each communicating between the first and second lanes, and wherein the first transfer station is spaced vertically above the second transfer station; a first rail co-extending and disposed in the first lane and projecting downward toward the first transfer station; a second rail co-extending and disposed in the second lane and projecting downward toward the first transfer station; a third rail co-extending and disposed in the first lane and projecting downward toward the second transfer station; a fourth rail co-extending and disposed in the second lane and projecting downward toward the second transfer station; a first rail extension projecting telescopically downward from the first rail; a second rail extension projecting telescopically downward from the second rail; a third rail extension projecting telescopically downward from the third rail; a fourth rail extension projecting telescopically downward from the fourth rail; and an elevator car constructed and arranged to travel in the hoistway and guided by the first, second, third, and fourth rails.

An elevator rail extension assembly for a ropeless elevator system having a rail extending along a vertical axis and in sliding engagement to a first structure portion with vertical displacement, according to another, non-limiting, embodiment includes a support bracket in contact with a stationary second structure portion; and a rail extension extending along the vertical axis and engaged to the second structure portion, and wherein the rail extension is axially aligned to the rail.

Additionally to the foregoing embodiment, the rail includes a tapered distal end portion that slideably inserts into the rail extension.

In the alternative or additionally thereto, in the foregoing embodiment, the rail includes a flange and the bracket includes a plate with the flange slideably disposed between the plate and the second structure portion.

In the alternative or additionally thereto, in the foregoing embodiment, the rail includes a guide member projecting outward from the flange, through the plate and into a hollow guide member of the rail extension.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
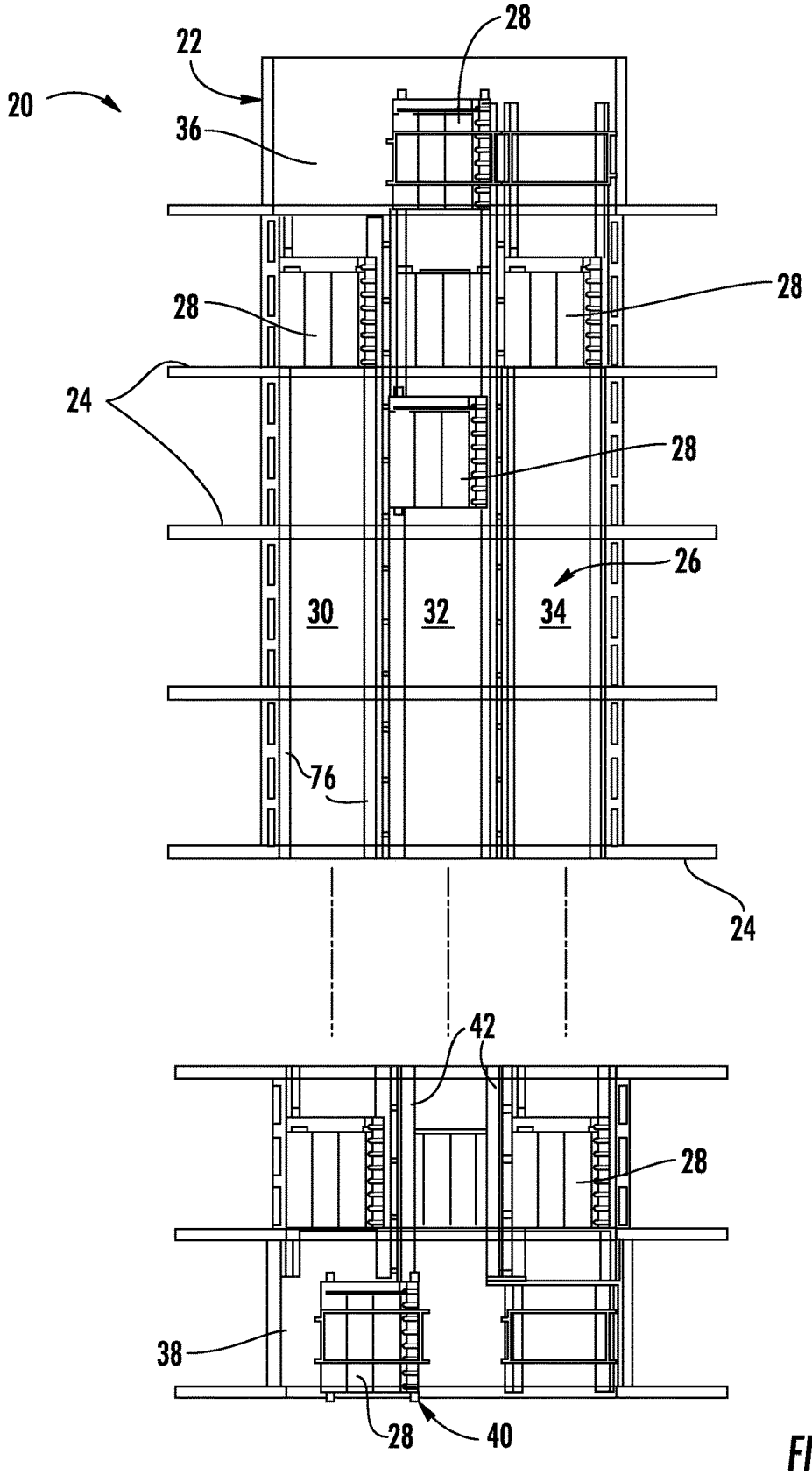
FIG. 1 depicts an elevator system in an exemplary embodiment.

FIG. 1 depicts a self-propelled or ropeless elevator system 20 in an exemplary embodiment that may be used in a structure or building 22 having multiple levels or floors 24. Elevator system 20 includes a hoistway 26 having boundaries defined by the structure 22 and at least one car 28 adapted to travel in the hoistway 26. The hoistway 26 may include, for example, three lanes 30, 32, 34 with any number of cars 28 traveling in any one lane and in any number of travel directions (e.g., up and down). For example and as illustrated, the cars 28 in lanes 30, 34, may travel in an up direction and the cars 28 in lane 32 may travel in a down direction.

Above the top floor 24 may be an upper transfer station 36 that facilitates horizontal motion to elevator cars 28 for moving the cars between lanes 30, 32, 34. Below the first floor 24 may be a lower transfer station 38 that facilitates horizontal motion to elevator cars 28 for moving the cars between lanes 30, 32, 34. It is understood that the upper and lower transfer stations 36, 38 may be respectively located at the top and first floors 24 rather than above and below the top and first floors, or may be located at any intermediate floor. Yet further, the elevator system 20 may include one or more intermediate transfer stations (not illustrated) located vertically between and similar to the upper and lower transfer stations 36, 38.

Figure 2:
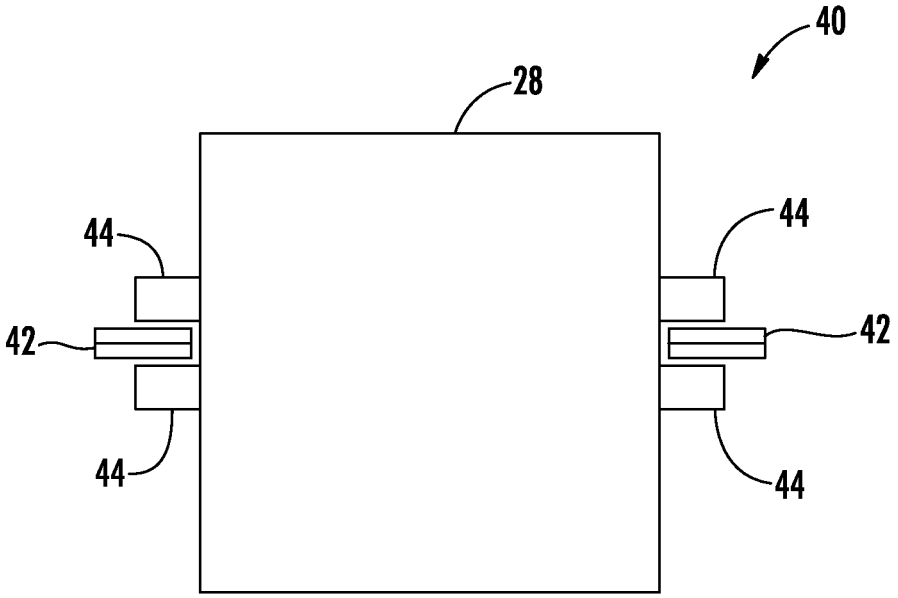
FIG. 2 is a top down view of a car and portions of a linear propulsion system in an exemplary embodiment.
Figure 3:
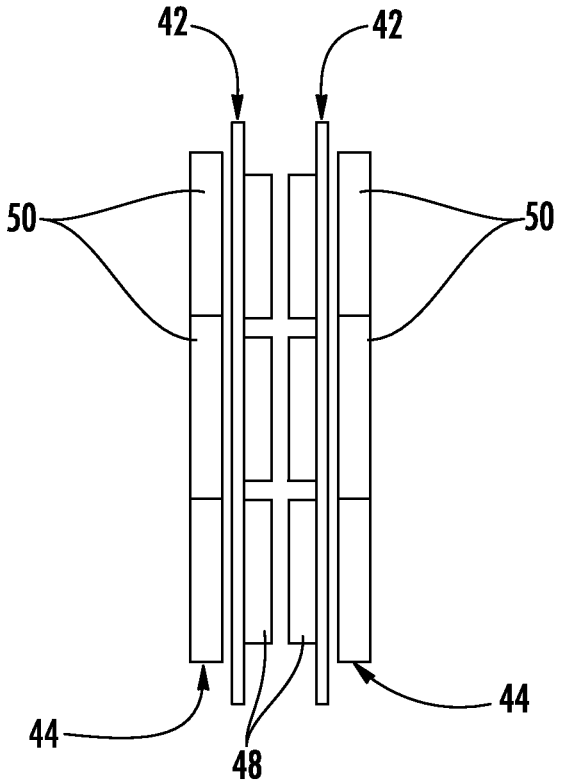
FIG. 3 is a front view of portions of a linear propulsion system in an exemplary embodiment.
Figure 4:
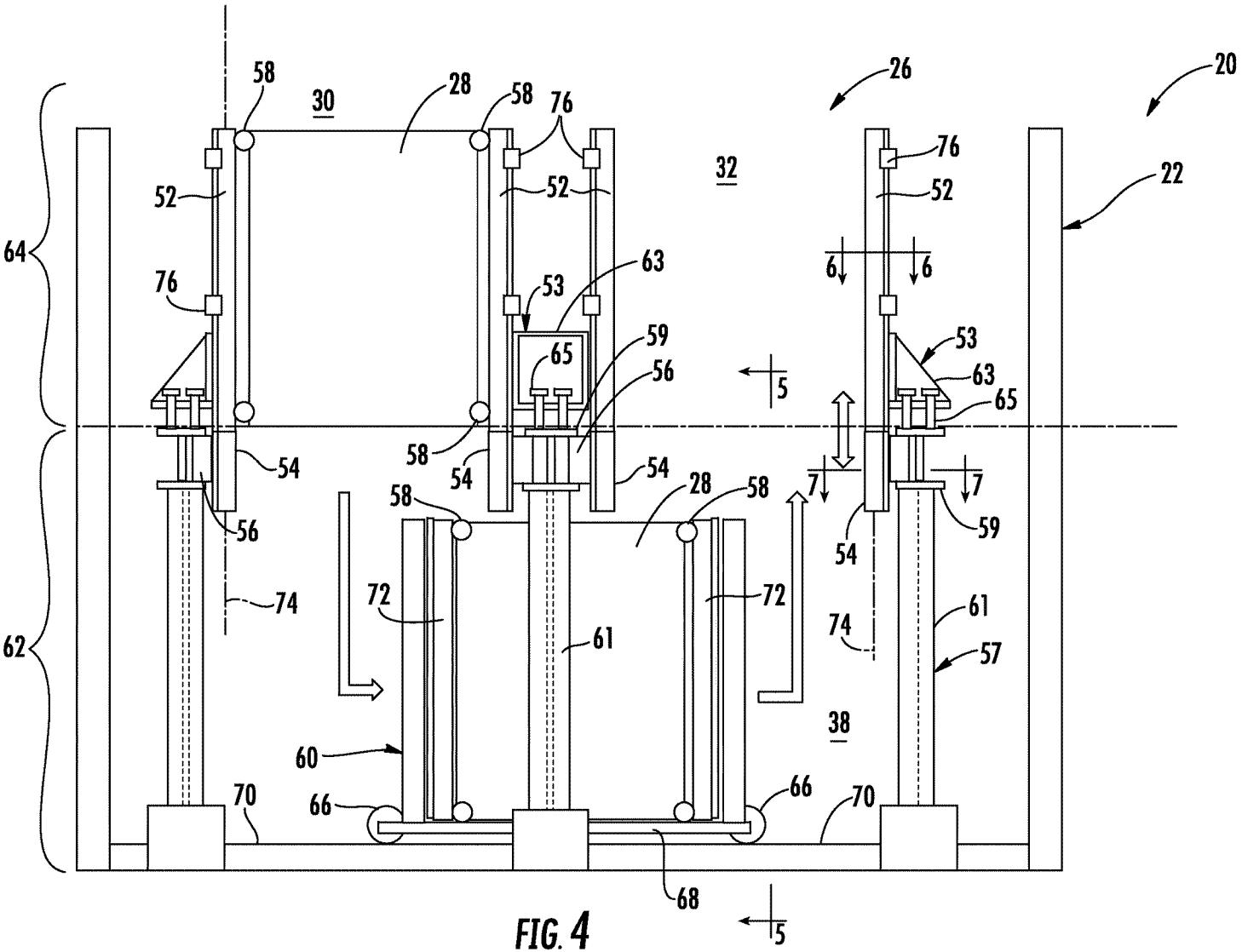
FIG. 4 is a side view of a transfer station of the elevator system.

Referring to FIGS. 1 through 3, cars 28 are propelled using a linear propulsion system 40 having fixed, primary portions 42 (e.g., four illustrated in FIG. 2), moving secondary portions 44 (e.g., four illustrated in FIG. 2), and a control system 46 (see FIG. 4). The primary portion 42 includes a plurality of windings or coils 48 mounted at one or both sides of the lanes 30, 32, 34 in the hoistway 26. The secondary portion 44 includes permanent magnets 50 mounted to one or both sides of cars 28. Primary portion 42 is supplied with drive signals from the control system 46 to generate a magnetic flux that imparts a force on the secondary portions 44 to control movement of the cars 28 in their respective lanes 30, 32, 34 (e.g., moving up, down, or holding still).

Referring to FIGS. 2 and 3, a first pair of secondary portions 44 of the linear propulsion system 40 is mounted on a first side of the car 28 and a second pair of secondary portions 44 is mounted on an opposite side of the car 28. Two, back-to-back, primary portions 42 are generally position between the secondary portions 44 of each pair. It is contemplated and understood that any number of secondary portions 44 may be mounted to the car 28, and any number of primary portions 42 may be associated with the secondary portions 44 in any number of configurations.

Figure 5:
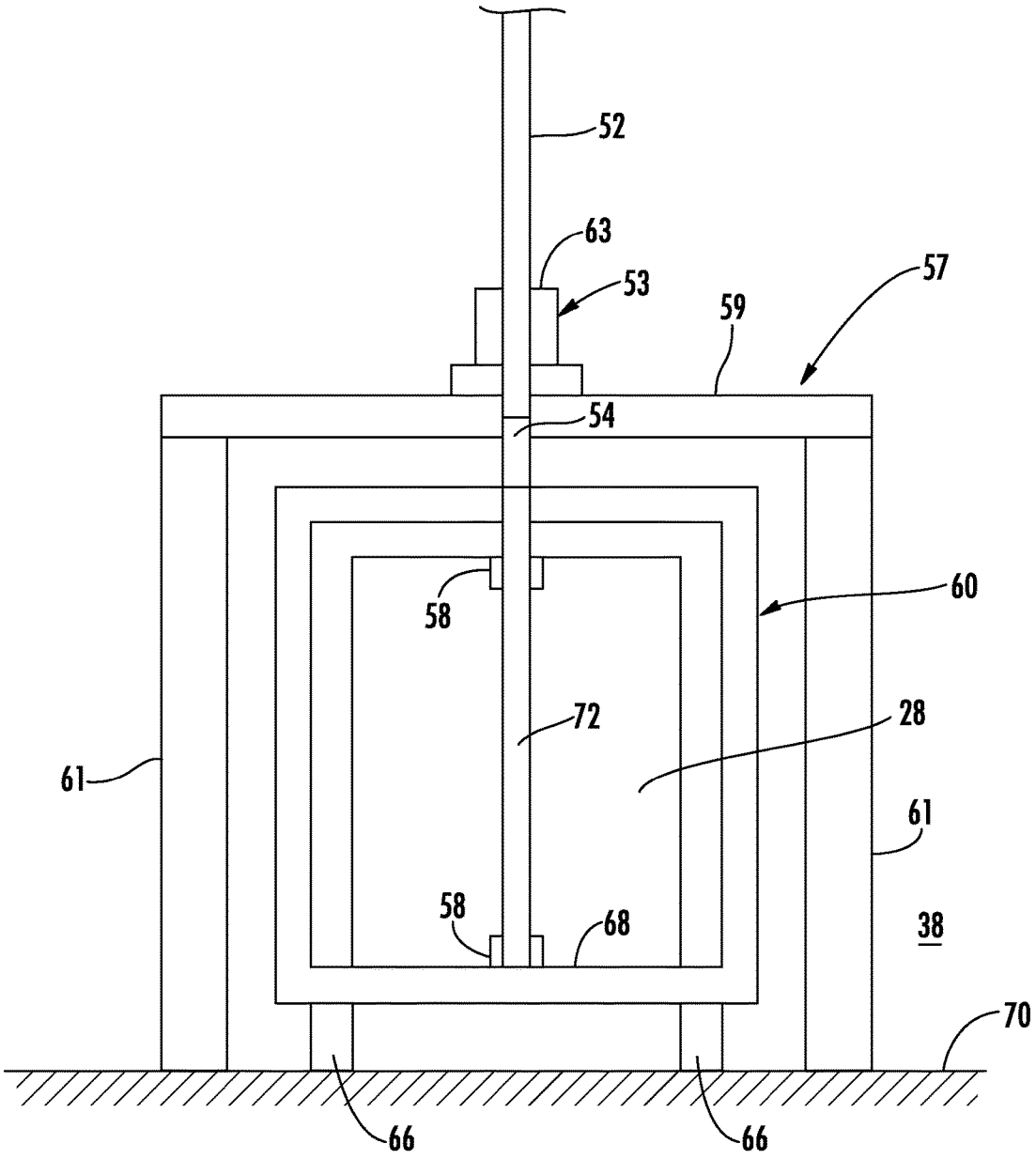
FIG. 5 is a front view of the transfer station taken along line 5-5 in FIG. 4.

Referring to FIGS. 4 and 5, and as an embodiment of the present disclosure, the elevator system 20 may further include at least one guide rail 52 (two illustrated) located in each lane 30, 32, 34 of the hoistway 26, a guide rail bracket 53 that may be adjustable, rail extension 54 telescopically projecting downward from each guide rail 52, a rail extension bracket 56 generally associated with each rail extension 54, guide device or rollers 58 secured to the car 28 for guiding the car along the guide rails 52 (four illustrated), a structure assembly 57 that may be an inverted u-shape, and a carriage 60 located in the transfer station 38 for receiving and shuttling the car 28 between lanes 30, 32, 34. The structure or building 22 may include a lower portion 62 that may generally be in and/or defines the transfer station 38; and, an upper portion 64 that is located above the lower portion 62, generally defines the lanes 30, 32, 34, and is generally under a compressive load causing vertical displacement of the upper portion 64 over a period of time.

The carriage 60 may include a shuttling means 66 that may be wheels rotationally secured to a platform 68 of the carriage 60 upon which the car 28 rests when being shuttled between lanes 30, 32, 34. The wheels 66 may roll upon a floor 70 of the lower portion 62 of the structure 22 that may define a lower most boundary of the transfer station 38. Alternatively, the wheels 66 may ride upon a horizontal rail (not shown) that is secured to the floor 70. Projecting upward from the platform 68 may be at least one coupling rail 72 (two illustrated) which are configured to align with the respective rail extensions 54. With a configuration of two guide rails 52 per lane 30, 32, 34, each car 28 may be associated with four guide rollers 58 respectively located at the top and bottom of the car 28.

Other shuttling means 66 may include, but are not limited to, pallets, rollers, hangers, and others. In certain embodiments, pallets may include self propelled pallets, rail guided pallets, pallets with primary "dummies" to interface with cars 28, pallets without primary "dummies", etc. Advantageously, by placing cars 28 on carriage 60, cars 28 are not required to have any special features to allow cars to be moved or manipulated in the station 38. Use of shuttling means 66 may allow additional car functions such as removing refuse and others. Shuttling means 66 may also facilitate the use of forklifts to move cars 28 and/or may be used in conjunction with station floor.

The storage or station floor may be utilized for use in station 38 to manage and store cars 28. In certain embodiments, cars 28 cannot move under their own power outside of hoistway 26, storage floor may allow for the cars 28 to be manipulated. In other embodiments, cars 28 may be propelled or moved when parked or stored by mechanisms integrated into car 28. In an exemplary embodiment, storage floor allows two dimensional movement of cars 28. In other embodiments, greater degrees of freedom and movement are enabled, including three degrees of freedom, or up to six degrees of freedom. Advantageously, cars 28 may be stored in any order and retrieved in any order to allow access and ease of dispatch.

In an exemplary embodiment, rollers 72*a*, 72*b*, 74, and 76 are utilized to move cars 14 about floor 70. In other embodiments, any suitable method is utilized to move cars 14 on floor 70. In an exemplary embodiment, rollers 72*a*, 72*b*, 74, and 76 are computerized rollers synchronized and coordinated to move cars 14 in a desired manner. Cars 14 may be stored on transport mechanism 60 for a unified rolling surface. Rollers 72*a* and 72*b* may be directional rollers to move the cars 14, while rollers 74 and 76 may be rolling ball type rollers to allow fine control over the position of cars 14. In certain embodiments, certain rollers 72*a*, 72*b*, 74, 76 are disposed in channels 78 to interface with features of cars 14 or transport mechanisms 60. In certain embodiments, any suitable robotic or automated rollers integrated into a floor 70 can be used. Advantageously, the use of rollers allows cars 14 to be stored in any desired order and retrieved in any desired manner. In certain embodiments, storage floor 70 is controlled by a centralized controller to determine the locations and retrieval of cars 14.

Although not shown, it is contemplated and understood that each car 28 may be guided by four rails 52 (i.e., in any one lane 30, 32, 34) each located at respective corners of the car 28. Each car 28 may then be associated with eight guide rollers 58 respectively located at the top and bottom corners of the car 28. In such a configuration, each lane 30, 32, 34 may be associated with four rail extensions 54, and the carriage 60 may include four coupling rails 72 that may project rigidly upward from each corner of the platform 68.

The structure assembly 57 may generally be part of the structure 22, and may be an inverted U-shape having a substantially horizontal support member 59 and two substantially vertical members or stanchions 61. Each stanchion 61 may be supported by and generally projects upward from the floor 70 of structure 22 with upper distal ends that may attach to respective ends of the horizontal support member 59. The height of the stanchions 61 and length of the support member 59 are long enough to permit passage of the carriage 60 and car 28 there-between (i.e., between the two stanchions 61, and between the floor 70 and the support member 59). The horizontal support member 59 may further support the guide rail bracket 53 and the rail extension bracket 56.

The guide rail bracket 53 may include a base 63 and an adjustment means 65 that may be threaded rods that are adjustably threaded to the base 63 (i.e., a jack bolt function), and having distal ends that bear upon the horizontal support member 59. The base 63 may be rigidly secured to lower end portions of each guide rail 52. During guide rail adjustment and as one, non-limiting, example, rotation of the threaded rods 65 will lift or lower the guide rails 52. During structure 22 settling or compression, the guide rails 52 may be lowered to prevent guide rail buckling. In-turn, the telescoping rail extensions 54 may be adjusted to maintain a consistent minimal distance between the distal lower ends of the extensions 54 and the distal upper ends of the coupling rails 72.

During car transfer operation, the carriage 60 may be transferred (e.g., rolled) horizontally and aligned beneath the lane 30 such that the upper distal ends of the coupling rails 72 are in close proximity to the lower distal ends of the rail extensions 54. Because each coupling rail 72 may be coaxially aligned to a substantially vertical axis 74 of each respective rail 52, the car 28 may be guided vertically from the lane 30 and into the carriage 60 for horizontal transport to another lane. For example, the carriage 60 while supporting the car 28 may roll beneath lane 32 aligning the coupling rails 72 with the rails 52 in the lane 32. Once aligned, the car 28 may be lifted into the lane 32 for continued operation therein.

To facilitate a smooth transition of the car 28 between the lanes 30, 32, 34 and transfer station 38, the opposing distal ends of the respective rail extensions 54 and coupling rails 72 should be in close proximity to one-another. To assure this relationship, the vertical distance between the floor 70 of the generally stationary lower portion 62 of the structure 22 is maintained at a consistent distance from the lower distal ends of the rail extensions 54. For example, the floor 70 may generally lie within an imaginary plane that is spaced from and substantially parallel to an imaginary plane that contains the lower distal ends of all of the rail extensions 54. That is, the bracket 56 which firmly holds the rail extension 54 in a set position is rigidly secured to the lower portion 62 of the structure 22. Because the floor 70 is part of the same lower portion 62, and the lower portion 62 is designed to resist any vertical displacement, the vertical distance between the floor 70 and the rail extensions 54 should remain substantially consistent and/or set (i.e. will not substantially change over time, and unlike the much taller first portion 64 of the structure 22).

Figure 6:
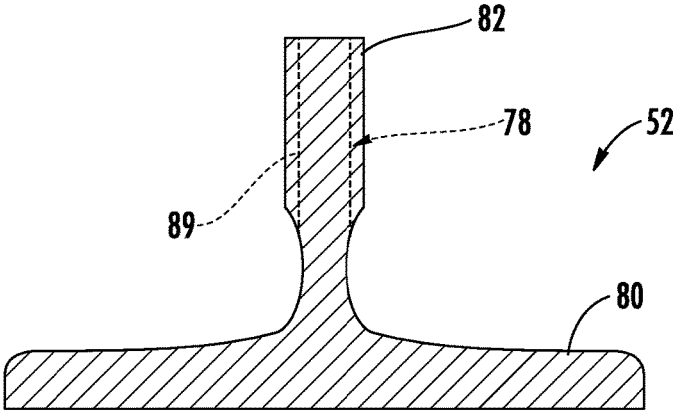
FIG. 6 is a cross section of a guide rail of the elevator system taken along line 6-6 of FIG. 4.
Figure 7:
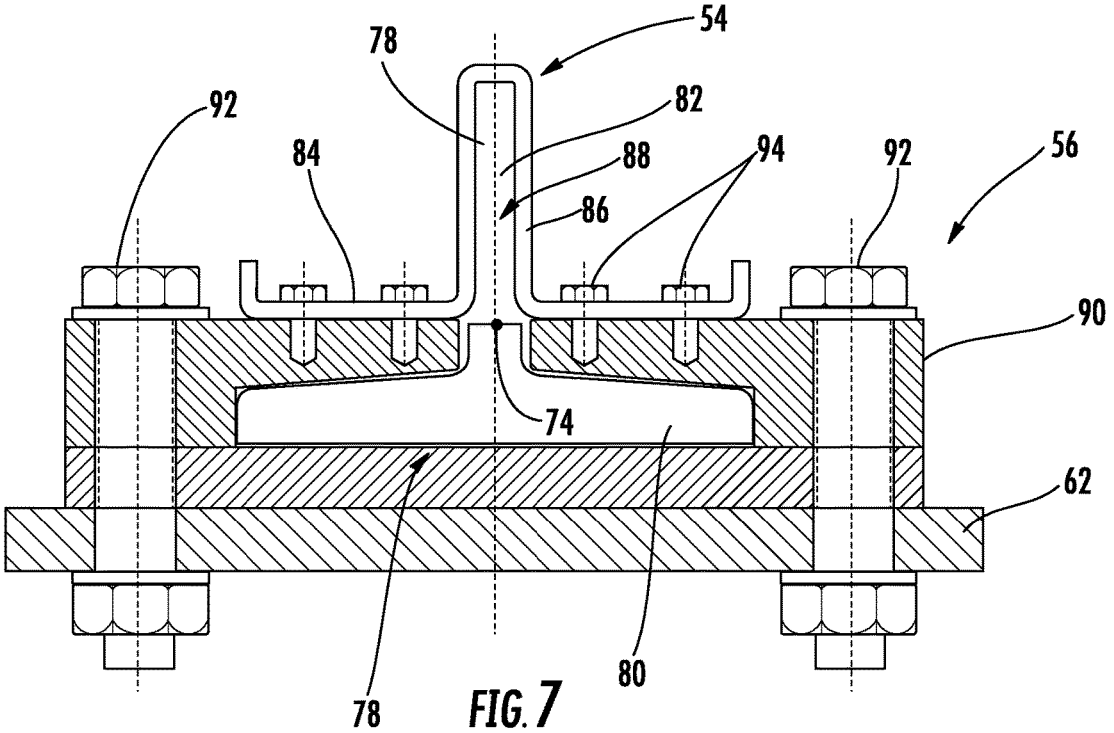
FIG. 7 is a cross section of a rail extension assembly of the elevator system taken along line 7-7 of FIG. 6.

The rail 52 may generally be divided into replaceable sections with each section secured to the adjacent upper portion 64 of structure 22 by a multitude of clips 76. The clips 76 generally resist the weight of each respective rail section such that the rail 52 will not slip downward through the clips via the rail weight alone. While the lower portion 62 of structure 22 generally does not undergo displacement over its own vertical height, the compressive forces produced by the much taller upper portion 64 of the structure 22 may produce a vertical displacement over its own vertical height. This compressive force and vertical displacement may require a vertical placement compensation for the rails 52. That is, the compressive force of the weight of the upper portion 64 combined with the weight of the rail 52 may generally cause the rail to slip through the clips 76 (i.e., as oppose to rail section bowing if no slippage occurred). This displacement may occur gradually over time and is compensated by the telescopic relationship between a lower distal end portion 78 of the rail 52 (see FIGS. 5 through 6) and the rail extension 54.

Referring to FIGS. 5 through 8, the guide rail 52 may generally include a flange 80 attached to the upper portion 64 of structure 22 by the clips 76, and a guide member 82 that projects outward from the flange 80 (see FIG. 6) for guide contact with the rollers 58 (i.e., a T-shaped guide rail 52). The distal end portion 78 of the rail 52 may include a portion 89 of the guide member 82 (see FIGS. 6 and 8) that has a tapered girth for sliding, axial, receipt into the rail extension 54. The rail extension 54 may include a flange 84 and a hollow guide member 86 that that defines a cavity 88 for receipt of the tapered guide member 82 of the distal end portion 78 of the rail 52.

The rail extension bracket 56 may include a plate 90, primary fasteners or bolts 92 and secondary fasteners or screws 94. The primary fasteners 92 may firmly secured the plate 90 to the fixed lower portion 62 of the structure 22. When assembled, the flange 80 of the rail 52 may be located between the plate 90 and the fixed lower portion 62 such that the rail 52 may slide vertically along axis 74 and through the bracket 56 (i.e., sliding contact with plate 90). The tapered portion 89 of the guide member 82 projects outward from the flange 80, through the plate 90 and into the cavity 88 defined by the hollow guide member 86 of the rail extension 54. The flange 84 of the rail extension 54 may be fixed to the plate 90 via the secondary fasteners 94.

Figure 8:
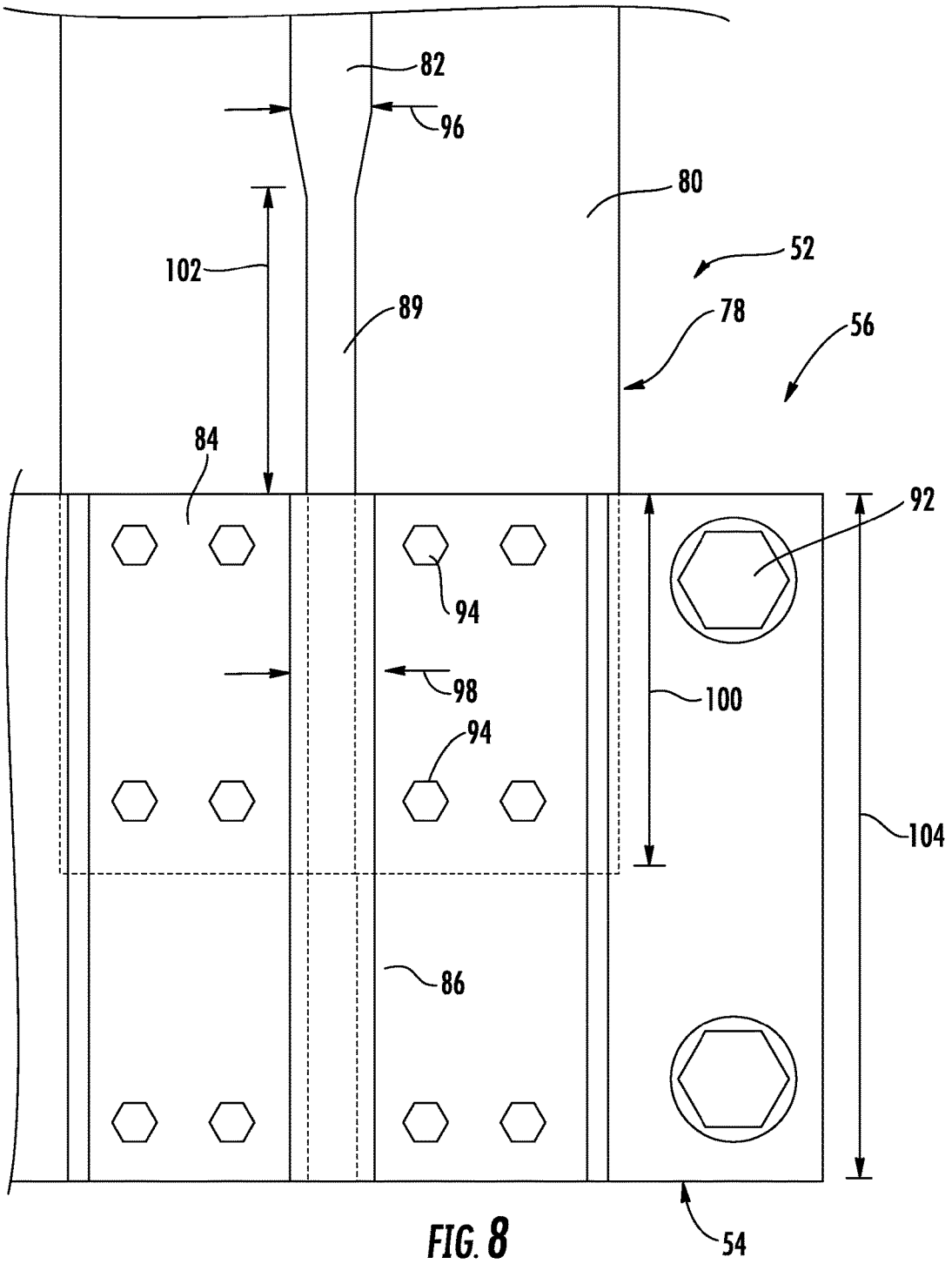
FIG. 8 is a front view of the rail extension assembly.

Referring to FIG. 8, when fully assembled, the distal end portion 78 of the guide rail 52 slides vertically with respect to the bracket 56 and the rail extension 54. The rail extension 54 and the bracket 56 may be rigidly fixed to, and stationary with, the lower portion 62 of the structure 22. The guide member 82 of the rail 52 has a girth (see arrow 96) that is substantially equal to an outer girth (see arrow 98) of the hollow guide member 86 of the rail extension 54 for smooth movement of the car 28 between the lanes 30, 32, 34 and the transfer station 38.

In operation and with the upper portion 64 of a structure 22 being about 1000 meters in height, vertical displacement of the upper portion 64 may be about 300 millimeters or greater due to compression over a period of time. With an expected displacement of 300 millimeters over a period of time, the distal end portion 78 of the guide rail 52 may be initially inserted into the rail extension 54 by about 50 millimeters (see arrow 100 in FIG. 7), with the end portion 78 and the tapered guide member portion 89 extending axially above the rail extension 54 by about another 300 millimeters (see arrow 102). To prevent the distal end portion 78 of ever making an undesired, obstructive, contact with the coupling rails 72 of the carriage 60, as the structure 22 compresses over time, the axial length (see arrow 104) of the rail extension 54 is about equal to or greater than 350 millimeters. It is understood that the height and displacement dimensions discussed above are merely a non-limiting example used to better describe operation of the elevator system 20.

It is further contemplated that the transfer stations 38 may not be located only in a pit area of the hoistway 26, but may be located in any number of vertical, intermediate, locations along the hoistway. Each transfer station of the plurality of vertically spaced transfer stations 38, may be positioned below a respective upper portion 64 of the structure 22. Moreover, each station 38 may be associated with respective guide rail(s) 52 located in each lane 30, 32, 34 of the hoistway 26, respective rail extension 54 telescopically projecting downward from each guide rail 52, respective brackets 53, 56 generally associated with each rail 52, respective structure assemblies 57, and a respective carriage 60 located in each transfer station 38 for receiving and shuttling the car 28 between lanes 30, 32, 34.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator system, comprising:

a first rail;

a first rail extension projecting telescopically downward from the first rail;

a structure defining a hoistway, wherein the first rail extends vertically in the hoistway;

an elevator car constructed and arranged to travel in the hoistway and guided by the first rail;

a second rail, wherein the hoistway includes first and second lanes each extending vertically with the first rail disposed in the first lane and the second rail extending vertically and disposed in the second lane; and a transfer station defined by the structure and communicating between adjacent lanes of the plurality of lanes, and wherein the first rail extension projects toward the transfer station.

2. The elevator system set forth in claim 1, further comprising:

a second rail extension projecting telescopically downward from the second rail and toward the transfer station.

3. The elevator system set forth in claim 2, wherein the first and second rail extensions are disposed at least in-part in the transfer station.

4. The elevator system set forth in claim 3, further comprising:

an elevator car constructed and arranged to travel in the first and second lanes and guided by the respective first and second rails.

5. The elevator system set forth in claim 4, further comprising:

a carriage disposed in the transfer station and constructed and arranged to receive the elevator car for transfer between the first and second lanes.

6. The elevator system set forth in claim 4, wherein the carriage includes a coupling rail aligned to the first rail extension when transferring the elevator car between the first lane and the transfer station and aligned to the second rail extension when transferring the elevator car between the second lane and the transfer station.

7. The elevator system set forth in claim 1, wherein the elevator system is ropeless.

8. An elevator system comprising:

a first rail; and a first rail extension projecting telescopically downward from the first rail;

a structure defining a hoistway; and an elevator car constructed and arranged to travel in the hoistway and guided by the first rail, wherein the structure includes a first portion and a second portion disposed above the first portion and substantially defining the hoist way, and wherein the first portion is generally stationary and the second portion is constructed and arranged to displace vertically under a compressive force of a weight of the second portion and over a period of time.

9. The elevator system set forth in claim 8, wherein the first rail extension is rigidly engaged to the first portion and the first rail is engaged to the second portion.

10. The elevator system set forth in claim 9, further comprising:

a plurality of rail clips engaged between the second portion and the rail, wherein each clip of the plurality of rail clips is spaced vertically from an adjacent clip of the plurality of clips, and wherein the rail displaces vertically with respect to the plurality of rail clips under a compressive load of the second portion.

11. The elevator system set forth in claim 9, wherein the first rail and the first rail extension slideably overlap vertically.

12. The elevator system set forth in claim 11, wherein a distal end portion of the first rail is vertically received in a cavity defined by the first rail extension.

13. An elevator system comprising:

a structure defining a hoistway including first and second lanes each extending vertically, and defining first and second transfer stations each communicating between the first and second lanes, and wherein the first transfer station is spaced vertically above the second transfer station;

a first rail co-extending and disposed in the first lane and projecting downward toward the first transfer station;

a second rail co-extending and disposed in the second lane and projecting downward toward the first transfer station;

a third rail co-extending and disposed in the first lane and projecting downward toward the second transfer station;

a fourth rail co-extending and disposed in the second lane and projecting downward toward the second transfer station;

a first rail extension projecting telescopically downward from the first rail;

a second rail extension projecting telescopically downward from the second rail;

a third rail extension projecting telescopically downward from the third rail;

a fourth rail extension projecting telescopically downward from the fourth rail; and an elevator car constructed and arranged to travel in the hoistway and guided by the first, second, third, and fourth rails.

14. An elevator rail extension assembly for a ropeless elevator system comprising:

a rail extending along a vertical axis and in sliding engagement to a first structure portion with vertical displacement;

a support bracket in contact with a stationary second structure portion; and a rail extension extending along the vertical axis and engaged to the second structure portion, and wherein the rail extension is axially aligned to the rail, wherein the rail includes a tapered distal end portion that slidably inserts into the rail extension, wherein the rail includes a flange and the bracket includes a plate with the flange slideably disposed between the plate and the second structure portion.

15. The elevator rail extension assembly set forth in claim 14, wherein the rail includes a guide member projecting outward from the flange, through the plate and into a hollow guide member of the rail extension.

* * * * *